US011666808B2

(12) United States Patent
Kodaka

(10) Patent No.: US 11,666,808 B2
(45) Date of Patent: Jun. 6, 2023

(54) GOLF CLUB HEAD

(71) Applicant: Sumitomo Rubber Industries, Ltd., Kobe (JP)

(72) Inventor: Jun Kodaka, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/583,655

(22) Filed: Jan. 25, 2022

(65) Prior Publication Data

US 2022/0249923 A1 Aug. 11, 2022

(30) Foreign Application Priority Data

Feb. 5, 2021 (JP) ..... JP2021-017031

(51) Int. Cl.
*A63B 53/04* (2015.01)

(52) U.S. Cl.
CPC ..... *A63B 53/0466* (2013.01); *A63B 53/0408* (2020.08); *A63B 53/0433* (2020.08); *A63B 53/0437* (2020.08)

(58) Field of Classification Search
CPC ... A63B 60/002; A63B 53/0466; A63B 53/08; A63B 2053/0491; A63B 2209/00; B32B 5/02; B32B 7/12; B32B 27/12; B32B 2262/101; B32B 2274/00; B32B 2307/10; B32B 2307/54
See application file for complete search history.

(56) References Cited

U.S. PATENT DOCUMENTS 6,059,669 A * 5/2000 Pearce ..... A63B 53/04 473/339
6,139,446 A * 10/2000 Wanchena ..... A63B 53/0466 473/328
D447,783 S * 9/2001 Glod ..... D21/752
6,623,374 B1 * 9/2003 Helmstetter ..... A63B 53/04 473/345
D484,937 S * 1/2004 Madore ..... D21/759
D567,889 S * 4/2008 Tang ..... D21/752
D579,507 S * 10/2008 Llewellyn ..... D21/759
7,651,414 B2 * 1/2010 Rae ..... A63B 53/0466 473/349

(Continued)

FOREIGN PATENT DOCUMENTS

JP 2020-124360 A 8/2020

*Primary Examiner* — William M Pierce
(74) *Attorney, Agent, or Firm* — Birch, Stewart, Kolasch & Birch, LLP

(57) ABSTRACT

A golf club head includes a club face, a crown, a leading edge, and a heel portion. The crown includes a first portion being adjacent to the club face, and a second portion being located backwardly of the first portion and connected to the first portion. The second portion is located below the first portion via a step portion. The first portion includes a face-vicinity portion extending in a toe-heel direction along the club face, and a heel-vicinity portion connected to a heel-side end portion of the face-vicinity portion and extending backwardly of the head along a heel-side contour of the crown. In a head plan view, a length A in a head front-back direction from the leading edge to a back-side end of the heel-vicinity portion is equal to or more than 70% of a maximum length B of the head in the head front-back direction.

17 Claims, 14 Drawing Sheets

(56) References Cited

U.S. PATENT DOCUMENTS

| | | | | |
|---|---|---|---|---|
| 7,758,440 | B2 * | 7/2010 | Llewellyn | A63B 53/0466 473/409 |
| 9,011,266 | B2 * | 4/2015 | Brunski | A63B 60/42 473/345 |
| D732,127 | S * | 6/2015 | Dolezel | D21/759 |
| 9,144,721 | B2 * | 9/2015 | Golden | A63B 60/00 |
| 9,839,819 | B2 * | 12/2017 | Mizutani | A63B 53/0466 |
| D834,662 | S * | 11/2018 | Oyler | D21/752 |
| 10,265,588 | B2 * | 4/2019 | Aramaki | A63B 53/0466 |
| 10,293,219 | B2 * | 5/2019 | Hayashi | A63B 53/0466 |
| 10,322,319 | B2 * | 6/2019 | Del Rosario | A63B 53/06 |
| 10,471,311 | B2 * | 11/2019 | Kato | A63B 53/0466 |
| 10,569,142 | B2 * | 2/2020 | Del Rosario | A63B 53/0466 |
| 2006/0079349 | A1 * | 4/2006 | Rae | A63B 53/0466 473/345 |
| 2008/0051210 | A1 * | 2/2008 | Park | A63B 53/047 473/290 |
| 2014/0274448 | A1 * | 9/2014 | Willett | A63B 53/04 473/327 |

* cited by examiner s1 cross section

GOLF CLUB HEAD

RELATED APPLICATIONS

This application claims the benefit of foreign priority to Japanese Patent Application No. JP2021-017031, filed Feb. 5, 2021, which is incorporated by reference in its entirety.

FIELD OF THE INVENTION

The present disclosure relates to a golf club head.

BACKGROUND OF THE INVENTION

Patent document 1 below discloses a golf club head which includes a crown portion with a step portion. The golf club head is formed so that the back side of the step portion is lowered with respect to the front side of the step portion. Such a golf club head is expected to have the effect of lowering the center of gravity of the golf club head.

[Patent document 1] Japanese Unexamined Patent Application Publication 2020-124360

SUMMARY OF THE INVENTION

In general golf clubs, the centers of gravity of club heads are located away from the centerlines of the golf club shafts toward toes of the golf club heads. As a result, as shown in FIG. 14, so-called "toe-down" may occur during the downswing. The toe-down is a phenomenon in which the toe side of the golf club head is lowered due to centrifugal force during the downswing. The toe-down may fluctuate the position or posture of the golf club head at impact, resulting deteriorating the flight distance and direction of the hit ball.

The present disclosure has been made in view of the above circumstances and has a major object to provide a golf club head capable of suppressing toe-down phenomenon.

In one aspect of the present disclosure, a golf club head includes a club face for striking a ball, a crown forming an upper surface of the golf club head, a leading edge, and a heel portion, wherein the crown includes a first portion being adjacent to the club face, and a second portion being located backwardly of the first portion and connected to the first portion, the second portion is located below the first portion via a step portion, the first portion includes a face-vicinity portion extending in a toe-heel direction along the club face, and a heel-vicinity portion connected to a heel-side end portion of the face-vicinity portion and extending backwardly of the golf club head along a heel-side contour of the crown, and in a plan view of the golf club head, a length (A) in a head front-back direction from the leading edge to a back-side end of the heel-vicinity portion is equal to or more than 70% of a maximum length (B) of the golf club head in the head front-back direction.

DETAILED DESCRIPTION OF THE INVENTION

Figure 1:
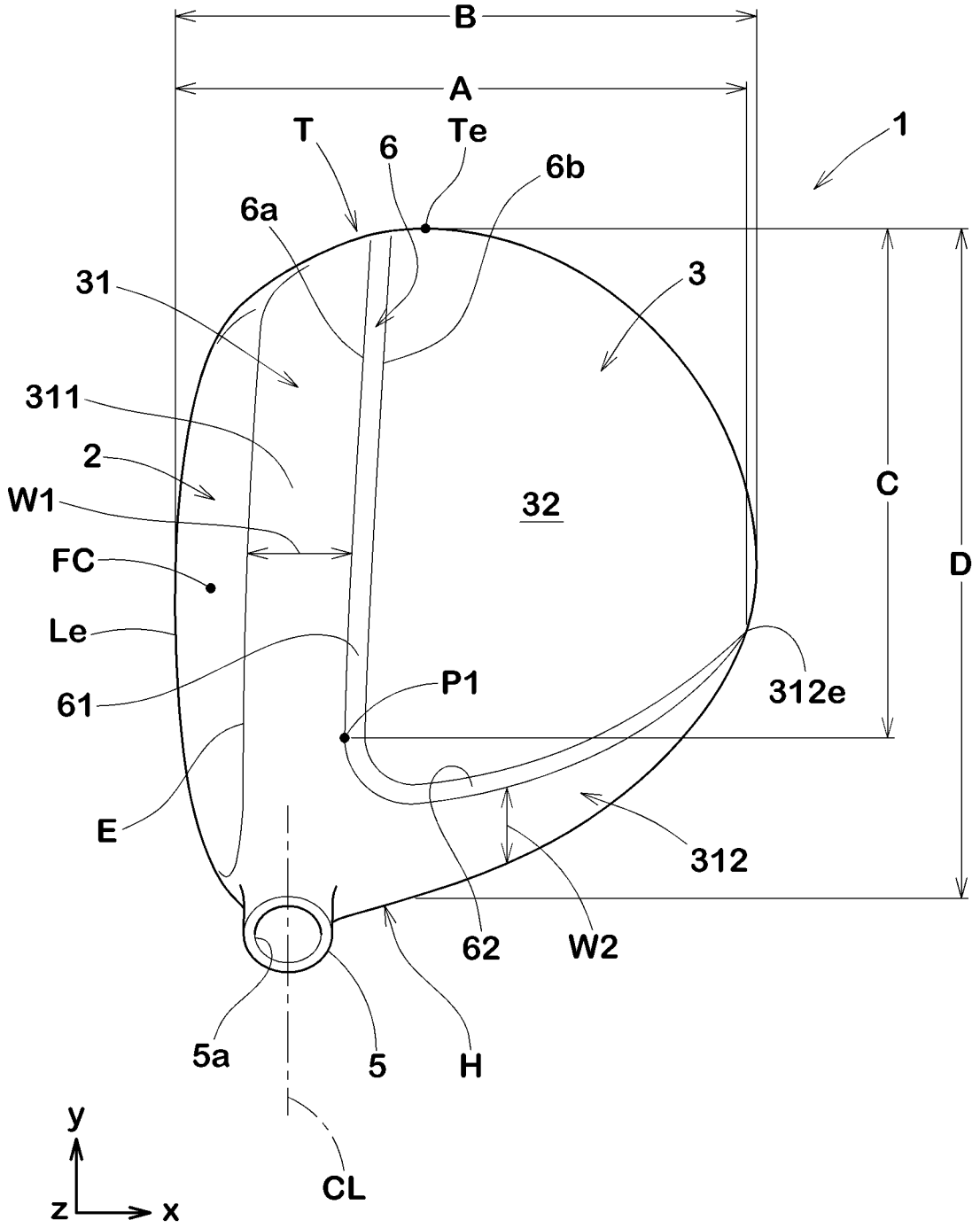
FIG. 1 is a plan view of a golf club head according to the present embodiment.

Hereinafter, one or more embodiments of the present disclosure will be described with reference to the drawings. Throughout the embodiments, the same or common elements are denoted by the same reference numerals, and duplicate explanations are omitted.

Figure 5:
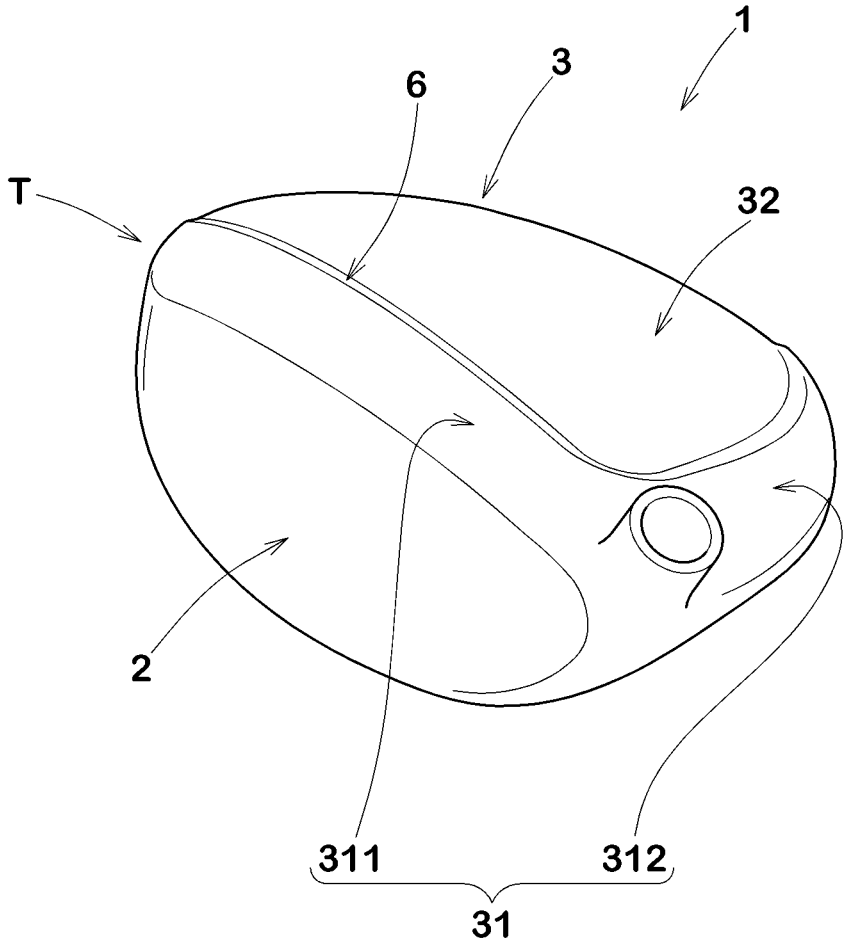
FIG. 5 is a perspective view of the golf club head viewed from the front and heel side in accordance with the present embodiment.
Figure 6:
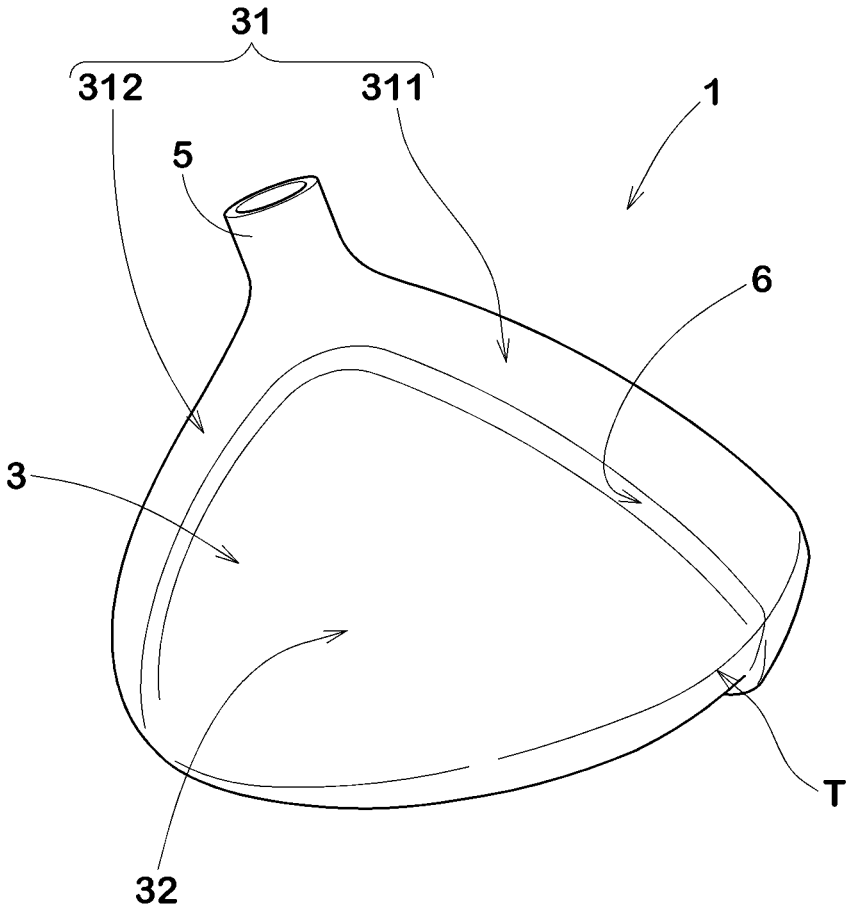
FIG. 6 is a perspective view of the golf club head viewed from the toe side in accordance with the present embodiment.
Figure 7:
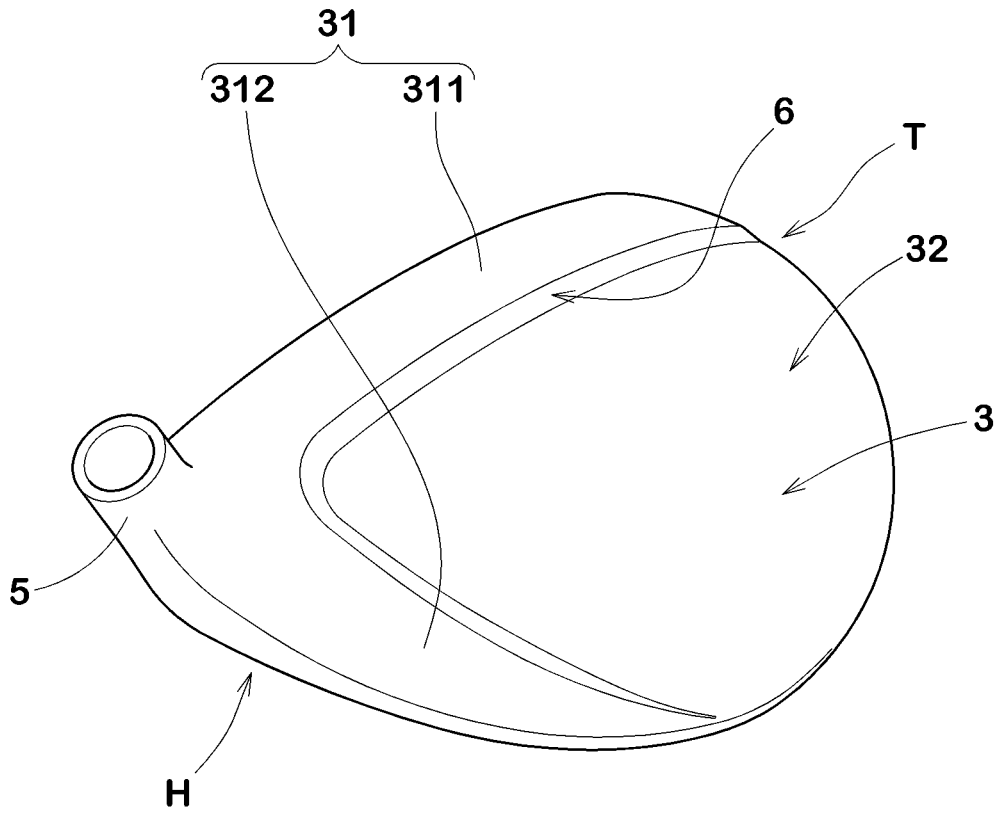
FIG. 7 is a perspective view of the golf club head viewed from the back and heel side in accordance with the present embodiment.

FIGS. 1 to 4 respectively illustrate a plan view, a front view, a side view viewed from a toe side, and a side view viewed from a heel side of the golf club head (hereinafter, simply referred to as "head") 1 according to the present disclosure. Further, FIGS. 5 to 7 respectively illustrate a perspective view viewed from the front and heel side, a perspective view viewed from the back and toe side, and a perspective view viewed from the back and heel side of the head 1 according to the present embodiment.

In FIGS. 1 to 7, the head 1, for example, includes a club face 2, a crown 3, a sole 4, a hosel 5, a toe T, and a heel H. In FIGS. 1 to 4, the head 1 is in a reference state as explained below.

[Reference State]

As used herein, the "reference state" of the head 1 means that the head 1 is placed on a horizontal plane HP with its lie angle $\alpha$ (FIG. 2) and the loft angle $\beta$ (FIG. 3) of the head 1. As illustrated in FIG. 3, in the reference state, the head 1 is positioned at its lie angle $\alpha$ and loft angle $\beta$ while the shaft axis centerline CL of the head 1 is arranged within a reference vertical plane VP perpendicular to the horizontal plane HP. Unless otherwise noted herein, the head 1 is under the reference state. The "shaft axis centerline CL" is defined by the axis centerline of a shaft insertion hole 5*a* formed in the hosel 5 of the head 1.

[Direction of Head]

As illustrated in FIG. 3, in the head 1 under the reference state, the direction x orthogonal to the reference vertical plane VP is defined as a head front-back direction of the head. In the head front-back direction of the head, the club face 2 side is the front side and the opposite side is a back or rear side. Further, the direction y parallel to both the reference vertical plane VP and the horizontal plane HP is defined as a toe-heel direction of the head 1. Furthermore, the direction z orthogonal to the horizontal plane HP is defined as a vertical direction of the head 1.

[Basic Structure of Head]

Figure 2:
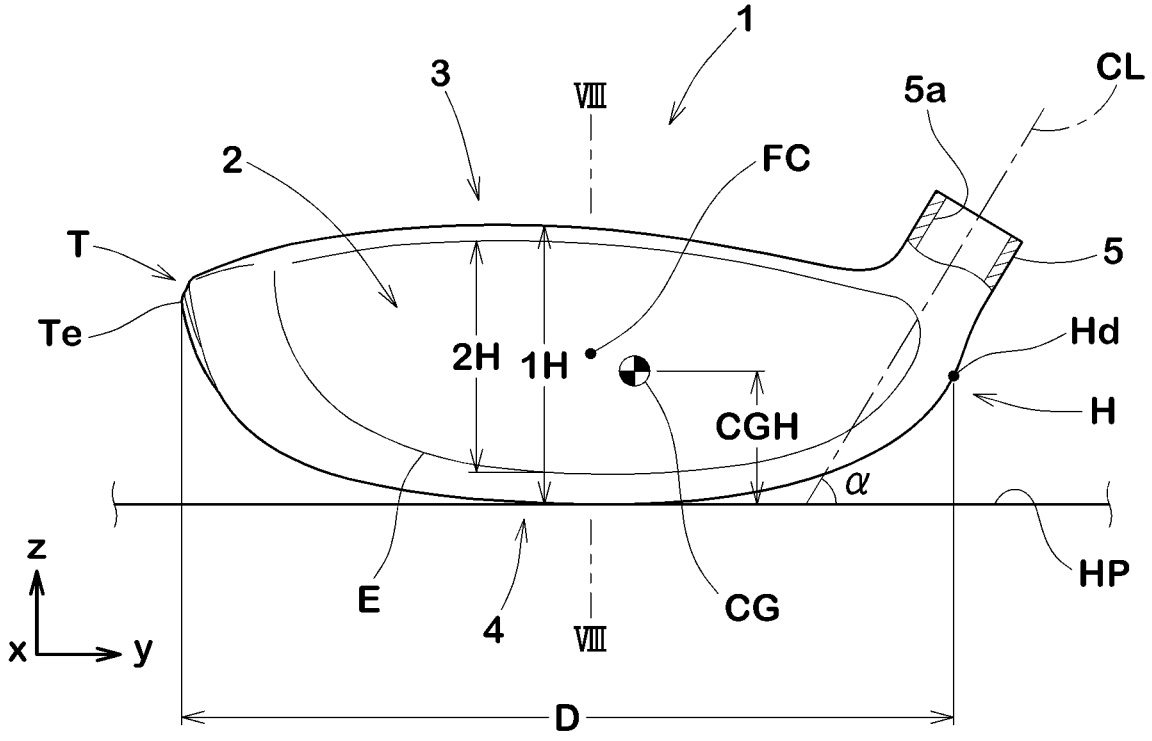
FIG. 2 is a front view of the golf club head according to the present embodiment.
Figure 3:
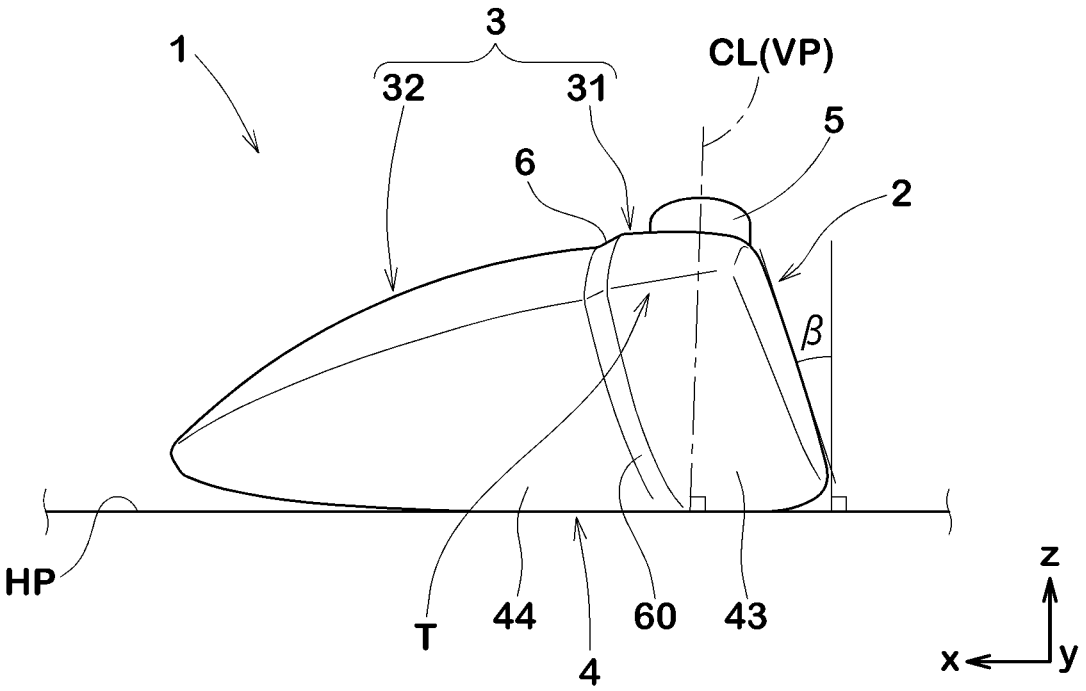
FIG. 3 is a side view of the golf club head viewed from a toe side in accordance with the present embodiment.
Figure 4:
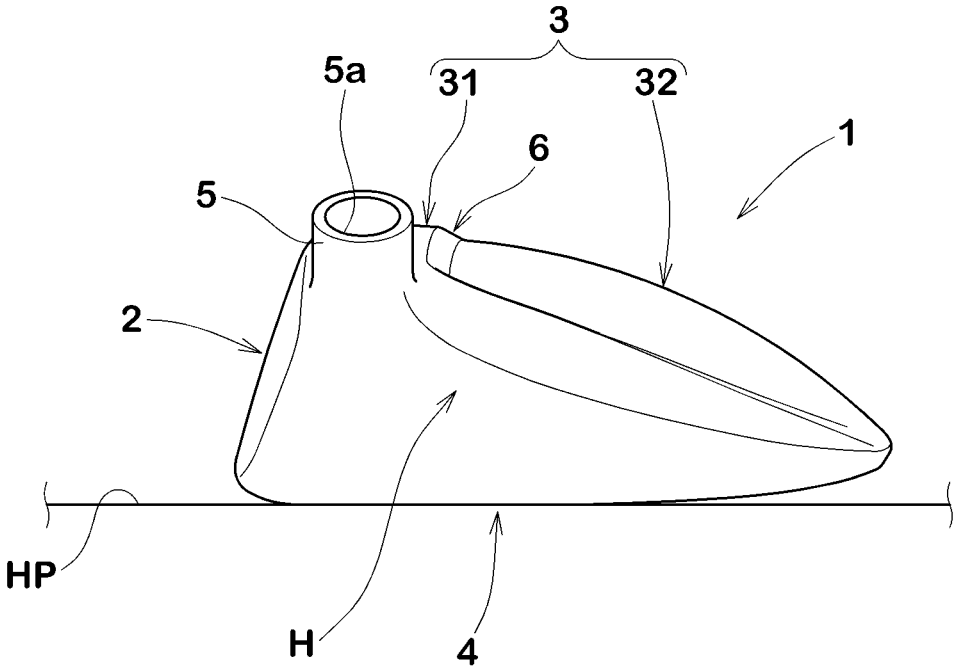
FIG. 4 is a side view of the golf club head viewed from the heel side in accordance with the present embodiment.
Figure 8:
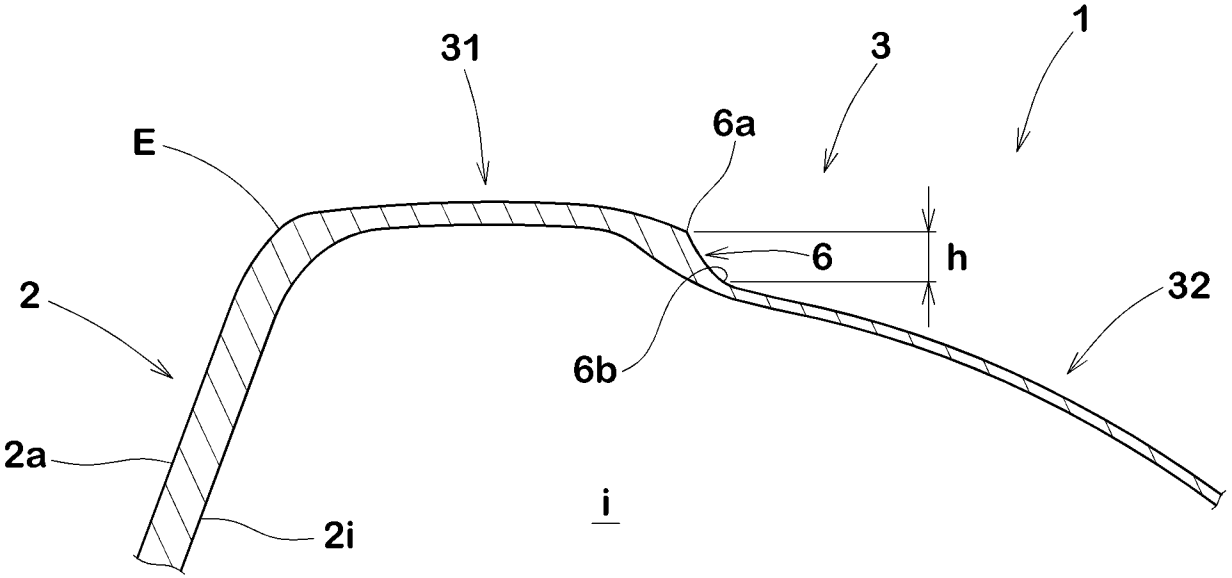
FIG. 8 is a cross-sectional view taken along the lines VIII-VIII of FIG. 2.

FIG. 8 illustrates a cross-sectional view taken along the lines VIII-VIII of FIG. 2. As illustrated in FIG. 8, the head 1 according to the present embodiment, for example, is configured as a golf club head having a hollow portion i therein. Heads of this type, for example, include a wood type or a hybrid type.

In particular, the present disclosure may preferably be embodied as a fairway wood or hybrid. These heads have a loft angle β of 13 to 35 degrees, a head weight of 200 g or more, and a head volume of 250 cc or less. FIG. 1 to FIG. 7 show a fairway wood as a preferred embodiment.

As illustrated in FIG. 8, the club face 2 includes a hitting face 2*a* which is a surface for striking a ball, and a face inner surface 2*i* which faces the hollow portion i. The hitting face 2*a*, for example, has a bulge and a roll. As a result, the hitting face 2*a* forms a three-dimensional curved surface that is convex outwardly toward the head.

Figure 9A:
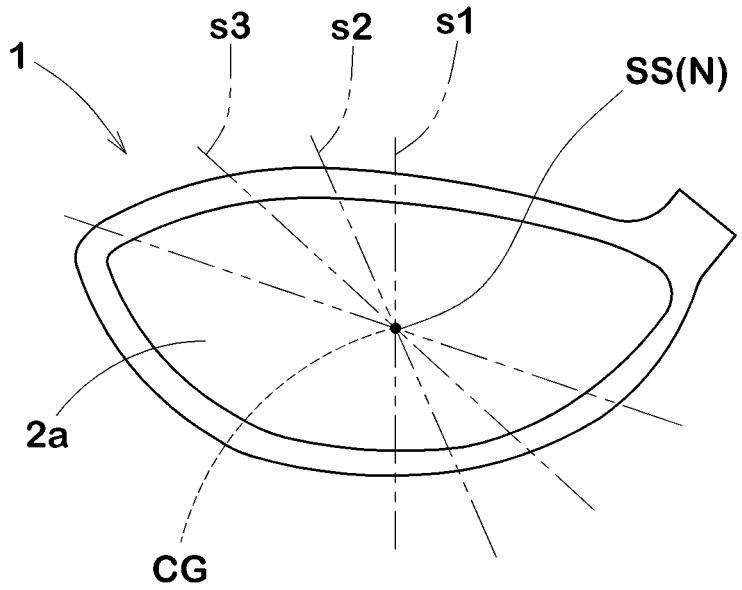
FIGS. 9A and 9B are a front view of a club face and a cross-sectional view taken along the line s1 of FIG. 9A, respectively, showing a periphery edge of the club face.

The hitting face 2*a* is defined by a peripheral edge E. As used herein, the peripheral edge E of the hitting face 2*a* is defined as follows. First, As illustrated in FIG. 9A, cross sections s1, s2, s3 . . . including the normal line N passing the center of gravity CG of the head and the sweet spot SS are specified. The sweet spot SS is the point where the normal line N drawn from the center of gravity CG of the head to the hitting face 2*a* intersects the hitting face 2*a*.

Figure 9B:
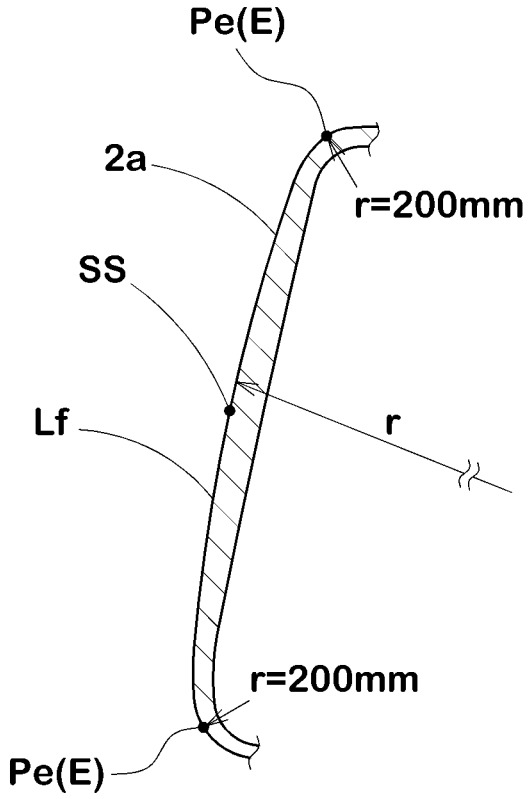

Next, as illustrated in FIG. 9B, in each of the cross sections s1, s2, s3 . . . , the positions Pe where the radius of curvature r of the contour line Lf on the hitting face 2*a* becomes 200 mm for the first time from the sweet spot SS side toward outwardly of the club face are specified, and a series of these positions Pe in the cross sections is defined as the peripheral edge E of the hitting face 2*a*. Note that a radius of curvature of a point (e.g., a first point) on a certain curve is defined as a radius of curvature of the single arc that passes the first point, a second point on the curve separated by 0.5 mm from the first point on one side, and a third point on the curve separated by 0.5 mm from the first point on the other side. Further, the above-mentioned "0.5 mm" is the distances along the curve.

The hitting face 2*a* includes a face center FC (shown in FIG. 1). As used herein the "face center" FC is determined in the following manner. First, a point P is selected roughly at the center of a hitting face 2*a* in the vertical direction and the toe-heel direction. Next, a plane that passes through the point P, extends in the normal direction of the hitting face at the point P, and is parallel to the toe-heel direction is determined. An intersection line between the plane and the hitting face 2*a* is drawn, and a midpoint Px of the intersection line is determined. Next, a plane that passes through the midpoint Px, extends in the normal direction of the hitting face 2*a* at the midpoint Px, and is parallel to the vertical direction of the head is determined. An intersection line between this plane and the hitting face 2*a* is drawn, and a midpoint Py of this intersection line is determined. Next, a plane that passes through the midpoint Py, extends in the normal direction of the hitting face 2*a* at the midpoint Py, and is parallel to the toe-heel direction is determined. An intersection line between this plane and the hitting face 2*a* is drawn, and a midpoint Px of this intersection line is newly determined. Next, a plane that passes through this newly-determined midpoint Px, extends in the normal direction of the hitting face 2*a* at this midpoint Px, and is parallel to the vertical direction is determined. An intersection line between this plane and the hitting face 2*a* is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes equal to or less than 0.5 mm, the newly-determined midpoint Py (the midpoint Py determined the last) is defined as the face center FC.

The hitting face 2*a* may be provided with a plurality of grooves extending in the toe-heel direction which are called face lines, but they are omitted from the drawings of this embodiment.

The crown 3 extends backwardly from the club face 2 to form a top surface of the head. The crown 3, for example, is the portion that is visible in the head plan view, excluding the club face 2. The hosel 5 is provided on the heel side of the crown 3. The hosel 5 is formed with a shaft insertion hole 5*a* for fixing a club shaft (not illustrated).

The sole 4 extend backwardly from the club face 2 to form a bottom surface of the head. The sole 4, for example, is the portion that is visible in the head bottom view.

A major part of the head 1, for example, is made of metallic material. Although the metallic material is not particularly limited, pure titanium, titanium alloy, stainless steel, maraging steel, aluminum alloy, magnesium alloy, tungsten-nickel alloy, etc. may be adopted, for example. A part of the head 1 (for example, a part of the crown 3) may be made of a non-metallic material such as fiber reinforced plastic.

[Crown Structure]

As illustrated in FIG. 1, the crown 3 includes a first portion 31 that is adjacent to the club face 2, and a second portion 32 that is located backwardly of the first portion 31 and connected to the first portion 31. In the present embodiment, both the first portion 31 and the second portion 32 have an outer surface that is smoothly convex toward outwardly of the head. The second portion 32 is located below the first portion 31 via a step portion 6.

In the present embodiment, the step portion 6 includes a front edge 6*a* located on the club face 2 side and a back edge 6*b* located behind the front edge 6*a*. As illustrated in FIG. 8, the step portion 6 according to the present embodiment is formed by a slope that descends from the front edge 6*a* toward the back edge 6*b*.

In the head 1 according to the present embodiment, the first portion 31 also includes a face-vicinity portion 311 and a heel-vicinity portion 312.

The face-vicinity portion 311 is a portion of the first portion 31 that extends along the club face 2 in the toe-heel direction. The heel-vicinity portion 312 is a portion of the first portion 31 that is connected to a heel-side end portion of the face-vicinity portion 311 and extends backwardly of the head along a heel-side contour of the crown 3. The face-vicinity portion 311 and the heel-vicinity portion 312 are both located above the second portion 32 and are raised from the second portion 32 via the step portion 6.

In the present embodiment, in a plan view of the head as shown in FIG. 1, a length A in the head front-back direction from a leading edge Le to a back-side end 312*e* of the heel-vicinity portion 312 is equal to or more than 70% of the maximum length B of the head in the head front-back direction.

[Effect 1 of the Embodiment]

Since the first portion 31 adjacent to the club face 2 is located above the second portion 32 via the step portion 6, an area of the club face 2 (especially, in the vertical dimension) is maintained larger, resulting in maintaining or improving the rebound performance of the club face 2. Such a club face 2, for example, can help to increase the initial velocity of hit balls. In some preferred embodiments, as illustrated in FIG. 2, the maximum vertical length 2H of the club face 2 can be expanded to 23 mm or more, more preferably 26 mm or more. Similarly, the maximum vertical length of 1H of the head 1 can be expanded to, for example, 30 mm or more, more preferably 35 mm or more.

Further, since the second portion 32, which is located backward of the head with respect to the first portion 31, is located below the first portion 31 via the step portion 6, a low center of gravity CG of the head can be provided. Such a head 1 can help to reduce the amount of backspin of hit balls. In some preferred embodiments, a center of gravity height CGH, which is the height of the center of gravity CG of the head (shown in FIG. 2) from the horizontal plane HP, can be 20 mm or less, more preferably 17 mm or less, for example.

In some preferred embodiments, as illustrated in FIG. 1, in a plan view of the head, an area A2 of the second portion 32 is greater than an area A1 of the first portion 31. This can provide the center of gravity CG of the head at a lower position. Here, the area A2 of the second portion 32 is the area surrounded by the head contour line and the back edge 6*b* of the step portion 6. Further, the area A1 of the first portion 31 is the area surrounded by the head contour line, the front edge 6*a* of the step portion 6, and the peripheral edge E of the club face 2 (including the hosel 5).

In some more preferred embodiments, a ratio A2/A1 of the area (A2) to the area (A1) is preferably in a range from 1.5 to 3.0, for example. Thus, by specifying the ratio of the areas A1 and A2 of the first portion 31 and the second portion 32, the increase in area of the club face 2 and the low center of gravity of the head can be achieved in a well-balanced manner.

[Effect 2 of the Embodiment]

In addition, the head 1 according to the present embodiment can suppress toe-down during the downswing. The mechanism of action can be as follows.

Figure 10:
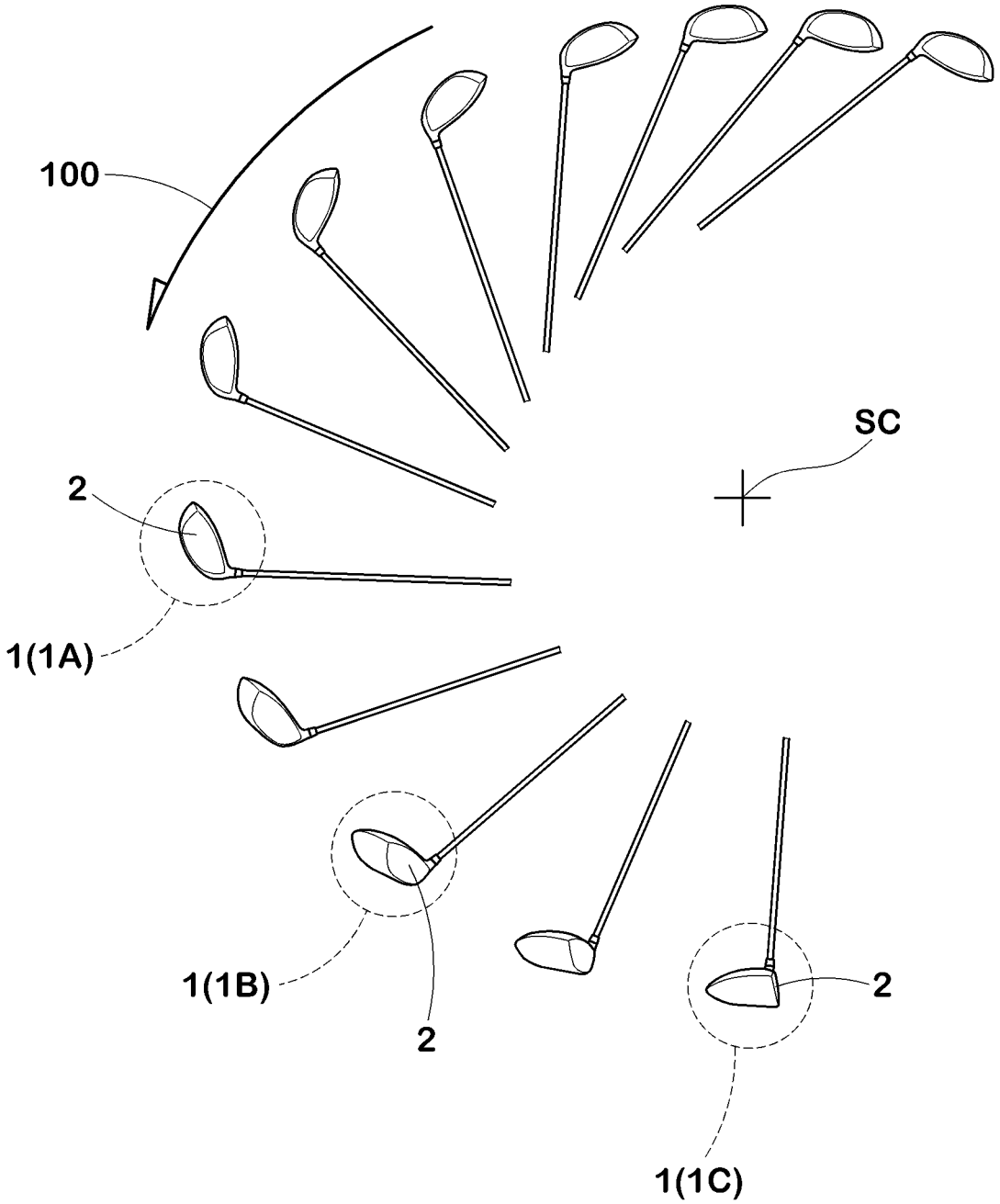
FIG. 10 is a diagram showing a trajectory of a golf club during a downswing.
Figure 11A:
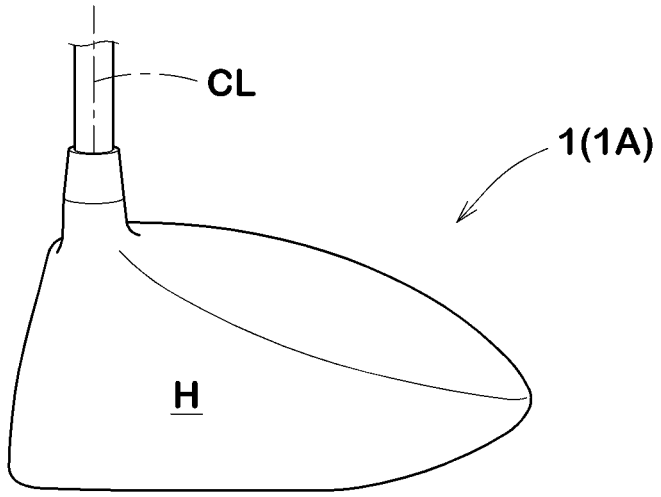
FIGS. 11A to 11C are front views of the golf club head 1A, 1B and 1C in FIG. 10 as viewed from the preceding side in the swing direction.
Figure 11B:
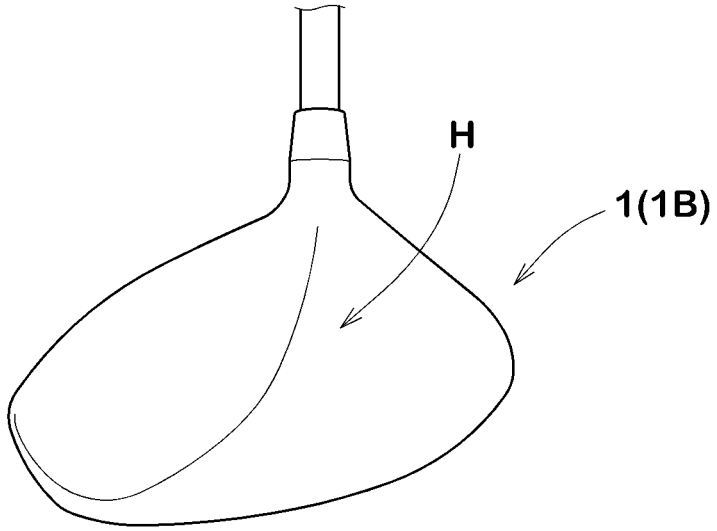
Figure 11C:
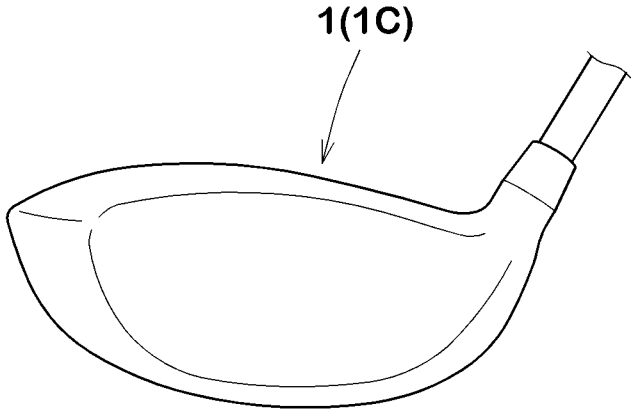

FIG. 10 is a diagram showing a trajectory of a golf club during a general downswing. This trajectory is a front view of a golfer (not illustrated), and the reference numeral 100 indicates the direction of movement of the head 1. FIGS. 11A to 11C are respectively views of the head 1A, 1B and 1C in the swing trajectory of FIG. 10 viewed from the preceding side in the swing direction at the respective positions.

As is clear from these figures, when the center SC of the swing trajectory is regarded as the center of the clock, the club face 2 of the head 1A at the position of about 9 o'clock faces almost the front. The head 1 gradually moves from there so that the club face 2 is closed (the head 1B), and then the club face 2 is completely closed at impact (the head 1C).

Further, as is clear of FIGS. 11A to 11B, during the downswing, the head 1 goes through the process of moving with the heel H side facing the swing direction. In particular, during the downswing, the head speed tends to accelerate rapidly in this process, and thus a surface of the head 1 on the heel H side receives a large amount of air resistance.

Figure 12:
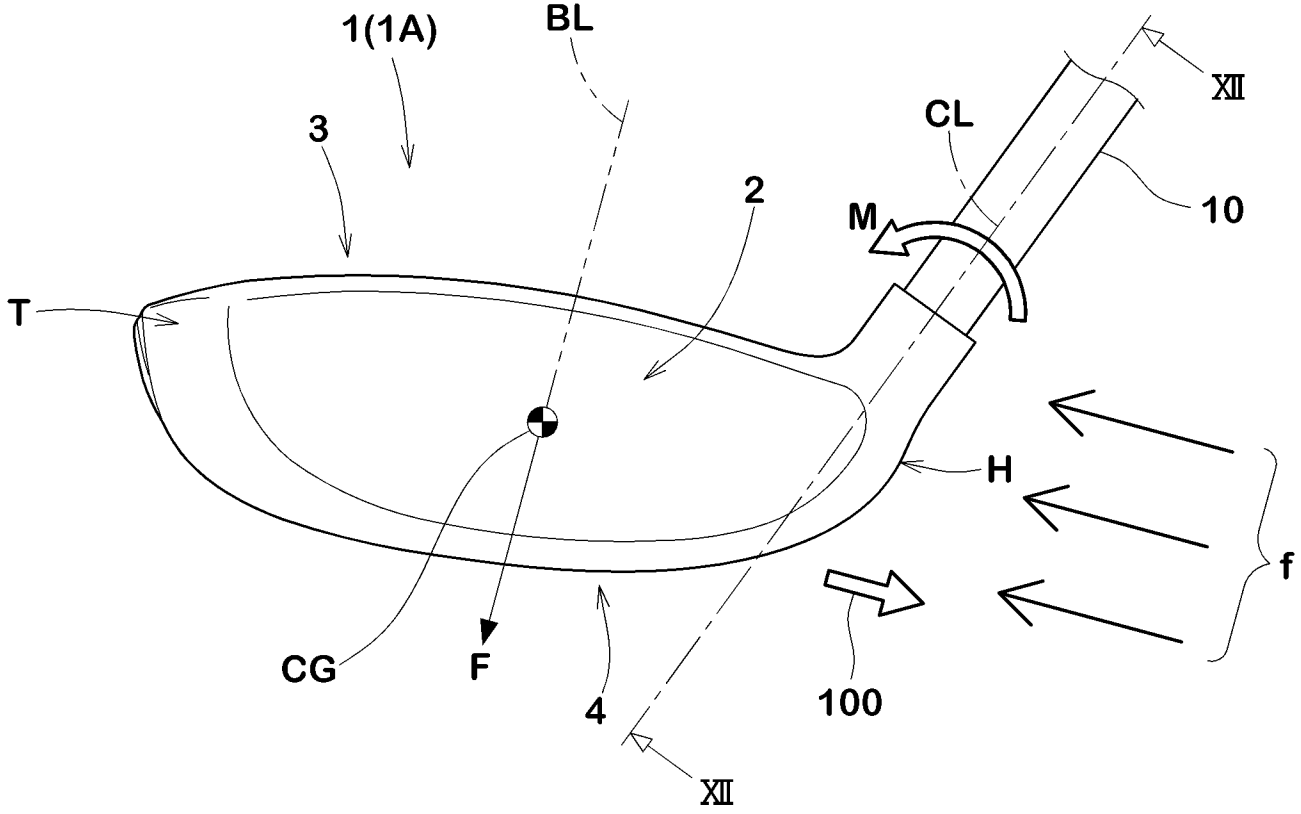
FIG. 12 is a diagram explaining the force received by the golf club head during a swing.

FIG. 12 shows the force that the head 1A receives at the position about 9 o'clock in FIG. 10. As illustrated in FIG. 12, centrifugal force F acts on the center of gravity CG of the head 1, and air resistance f acts on the heel H side. The reference symbol BL is the axis extending to the center SC of rotation of the golf club head 1. The centrifugal force F generates a rotational moment M that moves the head 1 in a direction (while bending the shaft 10) so that the center of gravity CG of the head approaches the shaft axis centerline CL. This brings the toe-down of the head 1. On the other hand, the air resistance f acts to resist the toe-down of the head 1.

In the head 1 according to the present embodiment, by increasing a projected area of the head 1 as seen from the heel H side, the air resistance f during the downswing can positively increase. That is, since the head 1 includes the heel-vicinity portion 312, a projected area of the head 1 as seen from the heel H side along the reference vertical plane VP and perpendicular to the shaft axis centerline CL (this is a projected area viewed from the line XII-XII of FIG. 12, and is shown in FIG. 11A) is larger than that of the head without the heel-vicinity portion 312. Further, since the air resistance f is proportional to the projected area of the head 1, the head 1 according to the present embodiment receives a larger air resistance f from the position of about 9 o'clock in the downswing to the subsequent process. Thus, in the present embodiment, the toe-down of the head 1 during the downswing can be effectively suppressed.

Here, when the length A in the head front-back direction from the leading edge Le to the back-side end 312*e* of the heel-vicinity portion 312 shown in FIG. 1 is less than 70% of the maximum length B of the head in the head front-back direction, the increase in the projected area cannot be expected sufficiently. Thus, the effect of suppressing the toe-down is not sufficiently obtained. Preferably, the length A is equal to or more than 80% of the maximum length B of head.

Hereinafter, more preferable specific embodiments will be described.

[Face-Vicinity Portion]

In order to maintain or increase the area of the club face 2, the face-vicinity portion 311 of the first portion 31 is preferably formed long enough in the toe-heel direction. For example, in a plan view of the head shown in FIG. 1, the face-vicinity portion 311 preferably extend from the contour line of the toe T of the head 1 and extend to the heel H side. In this case, as illustrated in FIG. 1, it is preferable not to protrude the face-vicinity portion 311 to the toe side. As a result, the contour line on the toe T of the head 1 can be formed by a smooth circular curve that is convex on the toe side without unevenness. In another embodiment, the face-vicinity portion 311 may be formed to start near the contour line of the toe T of the head 1 (for example, within 10 mm to the heel H side).

The first portion 31 according to the present embodiment extends to the heel H. That is, as can be understood from FIGS. 4 to 7, the heel H side of the first portion 31 is located above the surface on which an outer surface of the second portion 32 is virtually extended. Thus, the face-vicinity portion 311 according to the present embodiment also substantially extends to the heel H. In such an embodiment, the face-vicinity portion 311 is formed over the entire range of the toe-heel direction of the club face 2, effectively increasing the area of the club face 2. Hence, the rebound performance of the club face 2 can be further improved.

As illustrated in FIG. 1, a width W1 in the head front-back direction of the face-vicinity portion 311 is not particularly limited. From the viewpoint of improving the rebound performance of the club face 2, the width W1, for example, may be equal to or more than 5% of the maximum length B of the head, preferably equal to or more than 10%, more preferably equal to or more than 15%. Also, in view of providing a low center of gravity height CGH, the width W1 in the head front-back direction of the face-vicinity portion 311, for example, may be equal to or less than 45% of the maximum length B of the head, more preferably equal to or less than 40%, more preferably equal to or less than 35%. In addition, the width W1 in the head front-back direction of the face-vicinity portion 311 may be in a range of 5 to 25 mm.

[Heel-Vicinity Portion]

As illustrated in FIG. 1, the heel-vicinity portion 312 according to the present embodiment is formed as the area between the contour on the heel H side of the crown 3 and the front edge 6*a* of the step portion 6. That is, the heel-vicinity portion 312 defines the contour on the heel H side of the crown 3. Such a heel-vicinity portion 312 can effectively expand the projected area during the downswing as described above.

The back-side end 312*e* of the heel-vicinity portion 312 is more preferably located on the contour of the crown 3, for example. In another embodiments, the back-side end 312*e* of the heel-vicinity portion 312 may be located in front of the contour of the head 1.

In a plan view of the head shown in FIG. 1, it is preferable that a length W2 in the toe-heel direction of the heel-vicinity portion 312 continuously decreases toward the back side of the head. In this embodiment, the length W2 of the heel-vicinity portion 312 continuously decreases from the face-vicinity portion 311 to the back-side end 312*e* of the heel-vicinity portion 312 and is zero at the back-side end 312*e*. Such an aspect can help to suppress an increase in the center of gravity height CGH.

[Step Portion]

The step portion 6 according to the present embodiment extends from the toe side contour line of the crown 3 to the heel H side, and then curves backward of the head on the heel H side to the back side contour line of the crown 3. More specifically, the step portion 6 includes a first step portion 61 that extends in the toe-heel direction and a second step portion 62 that extends backward in the head front-back direction while curving smoothly from a first position P1 that is located on the heel side than the face center FC. Thus, the first step portion 61 separates the second portion 32 and the face-vicinity portion 311. In addition, the second step portion 62 separates the second portion 32 and the heel-vicinity portion 312.

The first step portion 61, for example, extends to the first position P1 substantially in parallel with the periphery edge E (the upper peripheral edge) of the club face 2. In some preferred embodiments, the first position P1 is for example, located on the heel H side away from the face center FC by a distance in the toe-heel direction equal to or more than 15 mm, more preferably equal to or more than 18 mm. This can ensure a large area of the second portion 32, resulting in providing a lower center of gravity height CGH. In addition, since the face-vicinity portion 311 is largely formed in the toe-heel direction, the rebound performance of the club face 2 can be further improved.

Alternatively, a length C in the toe-heel direction between the first position P1 and the toe end Te, for example, may be equal to or more than 60% of the maximum length D in the toe-heel direction of the head 1, more preferably equal to or more than 65%, still further preferably equal to or more than 70%. Referring to a front view of the head 1 in the reference state shown in FIG. 2, the maximum length D in the toe-heel direction of the head 1 is defined as a horizontal distance between the toe end Te that protrudes most toward the toe and the heel point Hd at a height of 22.23 mm from the horizontal plane HP. Further, the length C in the toe-heel direction between the first position P1 and the toe end Te is specified in a plan view of the head 1 in the reference state shown in FIG. 1.

In some more preferred embodiments, the first position P1 may be located on the heel h side in the toe-heel direction with respect to the back-side end 312*e* of the heel-vicinity portion 312. According to such an embodiment, a large area of the second portion 32 can be secured while ensuring a large air resistance as described above, and thus a lower head center of gravity height CGH can be provided.

The second step portion 62 begins to curve from the first position P1 and extends to the back side of the head along the heel side contour of the head 1. The second step portion 62 according to this embodiment has a smooth arc shape.

As illustrated in FIG. 8, a height h of the step portion 6 in the vertical direction between the front edge 6*a* and the back edge 6*b*, for example, is equal to or more than 1.0 mm, more preferably equal to or more than 1.5 mm, still further preferably equal to or more than 2.0 mm. Thus, the face-vicinity portion 311 and the heel-vicinity portion 312 are located higher than the second portion 32, and as a result, the rebound performance of the club face 2 and the effect of suppressing toe-down during downswing can further be improved. On the other hand, if the height h of the step portion 6 becomes excessively large, stress may be concentrated on the step portion 6 when hitting a ball. Thus, in view of the above, the height h of the step portion 6, for example, may be equal to or less than 7.0 mm, more preferably equal to or less than 6.5 mm, still further preferably equal to or less than 6.0 mm.

The height h of the step portion 6 according to the present embodiment is formed to be substantially constant except for the heel side end of the step portion 6. The height h of the step portion 6 may be taper off at its heel side end. In another embodiment, the height h of the step portion 6 may be different in each portion. The height of the second step portion 62 may be formed larger than the height of the first step portion 61, for example. This can effectively increase the projected area of the head as seen from the heel side.

In FIG. 1, although a width of the step portion 6 between the front edge 6*a* and the back edge 6*b* is not particularly limited, the width, for example, is preferably equal to or more than 1.0 mm, more preferably equal to or more than 1.5 mm, still further preferably equal to or more than 2.0 mm, but, for example, equal to or less than 7.0 mm, preferably equal to or less than 6.5 mm, still further preferably equal to or less than 6.0 mm.

[Sole Portion]

As illustrated in FIG. 3, the sole 4 may include a third portion 43 and a fourth portion 44 located on backward of the third portion 43. The third portion 43 may bulge with respect to the fourth portion 44 via a step portion 60. Such a head 1 can also help to maintain or increase the area of the club face 2. In this embodiment, the third portion 43 is formed to be substantially continuous with the first portion 31 in the toe T.

[Another Embodiment of Head]

Figure 13:
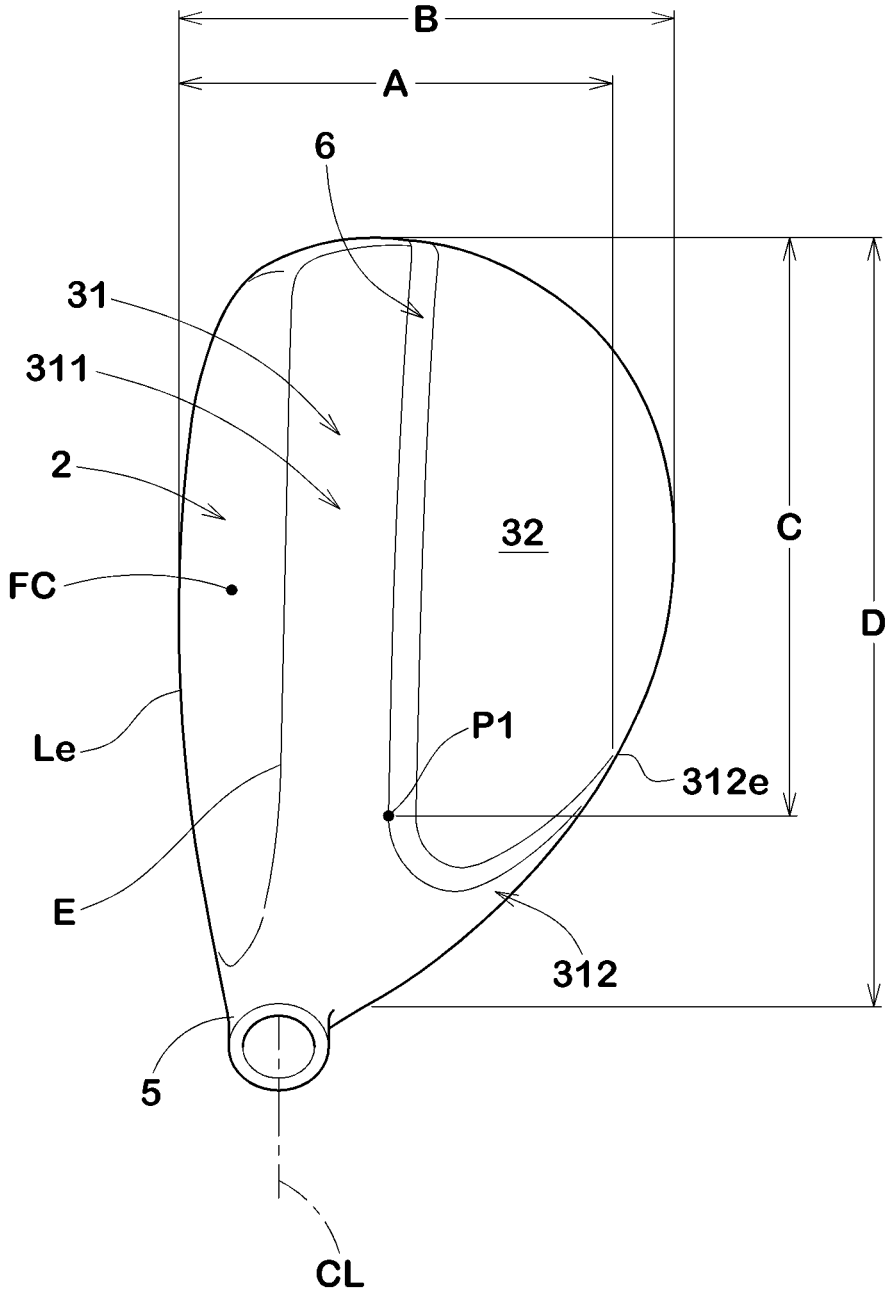
FIG. 13 is a plan view of the golf club head according to another embodiment.
Figure 14:
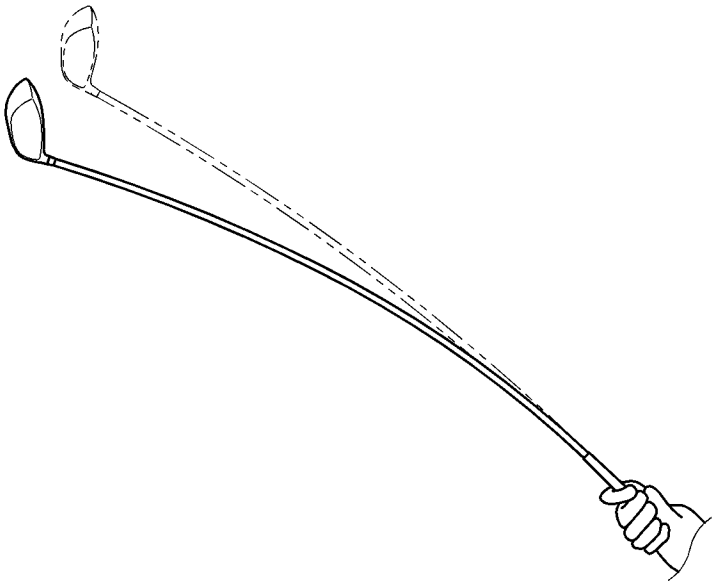
FIG.14 PRIOR ART
FIG. 14 is a front view of a golf club explaining toe-down during a swing.

FIG. 13 illustrates a plan view of the head 1 according to another embodiment. In FIG. 13, the head 1 is embodied as a hybrid. Thus, the present disclosure can be embodied in various forms.

While the particularly preferable embodiments in accordance with the present disclosure have been described in detail, the present disclosure is not limited to the illustrated embodiments, but can be modified and carried out in various aspects within the scope of the disclosure.

WORKING EXAMPLE

Hereinafter, more specific and non-limiting examples of the present disclosure will be described. A hollow fairway wood with the basic structure shown in FIGS. 1 to 7 was prepared based on the specifications in Table 1, and the center of gravity height CGH was measured. In addition, the drag force that correlates with the air resistance received by the head during the downswing was calculated by aerodynamic simulation using a computer. This drag force is the force received by the head (at head speed 30 m/s) in FIG. 11B in the direction perpendicular to the sheet surface of FIG. 11B. The larger the value, the more effective it is to suppress the toe-down. In addition, another golf club head (comparative example) was also prepared for comparison, and similar measurements and calculations were conducted. This head has a crown that is provided with the first portion, the second portion and the step portion between them. The first portion has a width of W1 and extends continuously in the toe-heel direction, consisting only of the face-vicinity portion. The results are shown in Table 1. In both the examples and comparative examples, the width W1 of the first portion was set to 16 mm.

TABLE 1

| | Comparative example | Example |
|---|---|---|
| Head volume (cc) | 161 | 162 |
| Ratio A/B (%) | — | 99 |
| Head projected area viewed from line XII-XII in FIG. 12 ($mm^2$) | 3959 | 4002 |
| Height h of step portion (mm) | 2 | 2 |
| Ratio C/D (%) | — | 73 |
| Area ratio A2/A1 | 3.9 | 2.4 |
| Center of gravity height CGH (mm) | 13.47 | 13.50 |
| Drag force received by head in FIG. 11B (N) | 1.81 | 1.82 |

As can be seen from Table 1, since the drag force in the downswing is larger in the example than in the comparative example, it is possible to suppress the toe-down.

The above description includes the features in the additional notes below.

[Additional Note 1]

A golf club head comprising:

a club face for striking a ball, a crown forming an upper surface of the golf club head, a leading edge, and a heel portion, wherein the crown comprises a first portion being adjacent to the club face, and a second portion being located backwardly of the first portion and connected to the first portion, the second portion is located below the first portion via a step portion, the first portion comprises a face-vicinity portion extending in a toe-heel direction along the club face, and a heel-vicinity portion connected to a heel-side end portion of the face-vicinity portion and extending backwardly of the golf club head along a heel-side contour of the crown, and in a plan view of the golf club head, a length (A) in a head front-back direction from the leading edge to a back-side end of the heel-vicinity portion is equal to or more than 70% of a maximum length (B) of the golf club head in the head front-back direction.

[Additional Note 2]

The golf club head according to Additional Note 1, wherein in a plan view of the golf club head, an area (A2) of the second portion is greater than an area (A1) of the first portion.

[Additional Note 3]

The golf club head according to Additional Note 2, wherein a ratio A2/A1 of the area (A2) to the area (A1) is in a range from 1.5 to 3.0.

[Additional Note 4]

The golf club head according to any one of Additional Notes 1 to 3, wherein in a plan view of the golf club head, a length in the toe-heel direction of the heel-vicinity portion decreases continuously backwardly of the golf club head.

[Additional Note 5]

The golf club head according to any one of Additional Notes 1 to 4, wherein the club face comprises a face center, and in a plan view of the golf club head, the step portion comprises a first step portion extending from a toe-side thereof toward a heel-side thereof in the toe-heel direction, and a second step portion extending smoothly in a curve manner from a first position located on a heel side than the face center.

[Additional Note 6]

The golf club head according to Additional Note 5, wherein the first position, in the toe-heel direction, is located on the heel side of the golf club head than the face center by a distance equal to or more than 15 mm.

[Additional Note 7]

The golf club head according to Additional Note 5 or 6, wherein a length (C) in the toe-heel direction between the first position and a toe end of the golf club head is in a range from 60% to 90% of a maximum length (D) of the golf club head in the toe-heel direction.

[Additional Note 8]

The golf club head according to any one of Additional Notes 5 to 7, wherein in a plan view of the golf club head, the back-side end of the heel-vicinity portion is located on a toe side in the toe-heel direction than the first position.

[Additional Note 9]

The golf club head according to any one of Additional Notes 1 to 8, further comprising a sole forming a bottom surface of the golf club head, wherein the sole comprises a third portion and a fourth portion located on backward of the third portion, and the third portion bulges with respect to the fourth portion via a step portion.

[Additional Note 10]

The golf club head according to Additional Note 9, wherein the third portion is substantially continuous with the first portion in a toe of the golf club head.

[Additional Note 11]

The golf club head according to any one of Additional Notes 1 to 10, being a fairway wood or a hybrid.

The invention claimed is:

1. A golf club head comprising:

a club face for striking a ball, a crown forming an upper surface of the golf club head, a toe portion, a heel portion, and a hosel having a shaft insertion hole defining a shaft axis centerline of the club head, wherein the club face comprises a face center, the crown comprises a first portion being adjacent to the club face, and a second portion being located backwardly of the first portion and connected to the first portion, the second portion is located below the first portion via a step portion, the first portion comprises a face-vicinity portion extending in a toe-heel direction along the club face, and a heel-vicinity portion connected to a heel-side end portion of the face-vicinity portion and extending backwardly of the golf club head along a heel-side contour of the crown, in a reference state in which the club head is placed on a horizontal plane with a lie angle and a loft angle of the club head, and the shaft axis centerline is arranged within a reference vertical plane perpendicular to the horizontal plane, and in a plan view of the golf club head which is a top view perpendicular to the horizontal plane, the step portion comprises a first step portion extending from a toe-side end thereof toward a heel-side end thereof in the toe-heel direction, and a second step portion extending backwards smoothly in a curved manner from a first position located on a heel side with respect to the face center to a back-side end of the heel-vicinity portion, the club head has a maximum length (B) that is a maximum length of the club head in a head front-back direction perpendicular to the reference vertical plane, the club head has a leading edge that defines a front-end point of the maximum length (B), the club head has a length (A) in the head front-back direction from the leading edge to a back-side end of the heel-vicinity portion which is an end located most backward position of the second step portion, and the length (A) is equal to or more than 70% of the maximum length (B) of the golf club head, and in the plan view of the golf club head, the back-side end of the heel-vicinity portion is located on a toe side in the toe-heel direction with respect to the first position.

2. The golf club head according to claim 1, wherein in the plan view of the golf club head, an area (A2) of the second portion is greater than an area (A1) of the first portion.

3. The golf club head according to claim 2, wherein a ratio A2/A1 of the area (A2) to the area (A1) is in a range from 1.5 to 3.0.

4. The golf club head according to claim 1, wherein in the plan view of the golf club head, a length in the toe-heel direction which is perpendicular to the head front-back direction of the heel-vicinity portion decreases continuously backwardly of the golf club head.

5. The golf club head according to claim 1, wherein the first position, in the toe-heel direction, is located on the heel side of the golf club head with respect to the face center by a distance equal to or more than 15 mm.

6. The golf club head according to claim 1, wherein the club head under the reference state, when viewed from a club face side of the club head perpendicular to the reference vertical plane, has a maximum length (D) that is a horizontal distance between a toe end that protrudes most toward the toe and a heel point (Hd) at a height of 22.23 mm from the horizontal plane, and the club head under the reference state in the plan view has a length (C) in the toe-heel direction between the first position and an end of the toe portion of the golf club head in a range from 60% to 90% of the maximum length (D).

7. The golf club head according to claim 1 further comprising a sole forming a bottom surface of the golf club head, wherein the sole comprises a third portion and a fourth portion located backward in the head front-back direction with respect to the third portion, and the third portion bulges with respect to the fourth portion via a step portion such that an area of the club face increases.

8. The golf club head according to claim 7, wherein the third portion is continuous with the first portion in a toe of the golf club head.

9. The golf club head according to claim 1, being a fairway wood or a hybrid.

10. The golf club head according to claim 2, wherein in the plan view of the golf club head, a length in the toe-heel direction which is perpendicular to the head front-back direction of the heel-vicinity portion decreases continuously backwardly of the golf club head.

11. The golf club head according to claim 3, wherein in the plan view of the golf club head, a length in the toe-heel direction which is perpendicular to the head front-back direction of the heel-vicinity portion decreases continuously backwardly of the golf club head.

12. The golf club head according to claim 5, wherein the club head under the reference state, when viewed from a club face side of the club head perpendicular to the reference vertical plane, has a maximum length (D) that is a horizontal distance between a toe end that protrudes most toward the toe and a heel point (Hd) at a height of 22.23 mm from the horizontal plane, and the club head under the reference state in the plan view has a length (C) in the toe-heel direction between the first position and a most toe end of the golf club head in a range from 60% to 90% of the maximum length (D).

13. The golf club head according to claim 5, wherein in the plan view of the golf club head, the back-side end of the heel-vicinity portion is located on a toe side in the toe-heel direction with respect to the first position.

14. The golf club head according to claim 6, wherein in the plan view of the golf club head, the back-side end of the heel-vicinity portion is located on a toe side in the toe-heel direction with respect to the first position.

15. The golf club head according to claim 1, wherein in the plan view of the golf club head, the length (A) is equal to or more than 80% of maximum length (B) of the golf club head.

16. The golf club head according to claim 1, wherein the second portion has an outer surface that is convex toward outwardly of the club head.

17. The golf club head according to claim 1, wherein a width (W1) in the head front-back direction of the face-vicinity portion ranges from 10% to 45% of the maximum length (B) of the club head.

* * * * *